US011007551B2

(12) United States Patent
Sauser

(10) Patent No.: US 11,007,551 B2
(45) Date of Patent: May 18, 2021

(54) VARIABLE SLOPE 3-SHAFT VIBRATING MECHANISM

(71) Applicant: Terex USA, LLC, Westport, CT (US)

(72) Inventor: Edwin J. Sauser, Monticello, IA (US)

(73) Assignee: Terex USA, LLC, Westport, CT (US)

( * ) Notice: Subject to any disclaimer, the term of this patent is extended or adjusted under 35 U.S.C. 154(b) by 0 days.

(21) Appl. No.: 16/865,846

(22) Filed: May 4, 2020

(65) Prior Publication Data

US 2020/0261943 A1 Aug. 20, 2020

Related U.S. Application Data

(63) Continuation of application No. 15/831,632, filed on Dec. 5, 2017, now Pat. No. 10,654,072, which is a continuation of application No. 12/540,120, filed on Aug. 12, 2009, now Pat. No. 9,862,003.

(60) Provisional application No. 61/088,987, filed on Aug. 14, 2008.

(51) Int. Cl.
*B07B 1/42* (2006.01)
*B07B 1/28* (2006.01)

(52) U.S. Cl.
CPC ..... *B07B 1/42* (2013.01); *B07B 1/286* (2013.01)

(58) Field of Classification Search
CPC ..... B07B 1/42; B07B 1/286
USPC ..... 209/315, 326, 341, 370
See application file for complete search history.

(56) References Cited

U.S. PATENT DOCUMENTS

| | | | | |
|---|---|---|---|---|
| 1,500,856 | A | 7/1924 | D | |
| 1,630,172 | A | 5/1927 | W | |
| 1,931,657 | A | 10/1933 | Hetzel | |
| 2,069,331 | A | 2/1937 | Munro et al. | |
| 2,120,032 | A | 6/1938 | James et al. | |
| 2,367,070 | A | 1/1945 | G | |
| 2,638,226 | A | 5/1953 | Adam et al. | |
| 2,707,559 | A * | 5/1955 | Saxe | B07B 1/343 209/325 |
| 2,819,796 | A * | 1/1958 | Edwards | B07B 1/46 209/319 |
| 3,245,150 | A | 4/1966 | H et al. | |
| 3,261,470 | A | 7/1966 | J | |
| 3,332,293 | A | 7/1967 | L et al. | |
| 3,424,515 | A | 1/1969 | George | |
| 3,425,552 | A | 2/1969 | G | |
| 3,442,381 | A | 5/1969 | W | |
| 3,926,793 | A * | 12/1975 | Wise | B03B 5/36 209/426 |
| 4,076,124 | A | 2/1978 | Taysom et al. | |
| 4,139,287 | A | 2/1979 | Wessinger | |
| 4,155,840 | A | 5/1979 | Gauld et al. | |

(Continued)

FOREIGN PATENT DOCUMENTS

KR 20030035664 5/2003

*Primary Examiner* — Terrell H Matthews
(74) *Attorney, Agent, or Firm* — Simmons Perrine Moyer Bergman PLC

(57) ABSTRACT

Disclosed is a vibrating material sorting screen with a substantially variable tilt angle and a tilt angle measuring device where the screen has a gear box which is horizontal when the screen is horizontal and inclined when the screen is inclined and further where the gear box has a plurality of oil level sensors or indicators therein which are sized, placed and configured to provide proper oil volume while the screen is oriented horizontally or at various inclines.

20 Claims, 7 Drawing Sheets

(56) References Cited

U.S. PATENT DOCUMENTS

| | | | | | |
|---|---|---|---|---|---|
| 4,165,655 | A | * | 8/1979 | Alford | B06B 1/162 74/61 |
| 4,579,508 | A | | 4/1986 | Tsumaki et al. | |
| 4,632,751 | A | * | 12/1986 | Johnson | B07B 1/42 198/770 |
| 4,759,508 | A | | 7/1988 | Griffith et al. | |
| 4,797,204 | A | | 1/1989 | Lower et al. | |
| 4,882,054 | A | | 11/1989 | Derrick et al. | |
| 5,232,099 | A | | 8/1993 | Maynard | |
| 5,494,173 | A | * | 2/1996 | Deister | B07B 1/42 209/326 |
| 6,142,308 | A | | 11/2000 | Ghosh et al. | |
| 6,347,708 | B1 | * | 2/2002 | Ostergaard | B07B 1/42 209/326 |
| 6,386,375 | B1 | | 5/2002 | Olsen | |
| 6,830,155 | B2 | | 12/2004 | Trench et al. | |
| 6,889,846 | B2 | | 5/2005 | Olsen et al. | |
| 6,918,492 | B2 | | 7/2005 | Ostergaard | |
| 2006/0054539 | A1 | | 3/2006 | Antila et al. | |
| 2008/0128334 | A1 | | 6/2008 | Scott et al. | |
| 2010/0018909 | A1 | | 1/2010 | Smith | |
| 2013/0037450 | A1 | * | 2/2013 | Schirm | B07B 1/28 209/233 |

* cited by examiner

VARIABLE SLOPE 3-SHAFT VIBRATING MECHANISM

CROSS REFERENCE TO RELATED APPLICATIONS

This application is a continuation of the non-provisional patent application having Ser. No. 15/831,632, which was filed on Dec. 5, 2017; which application was a continuation of and claims the benefit of the filing date of non-provisional patent application entitled "VARIABLE SLOPE 3-SHAFT VIBRATING MECHANISM", having Ser. No. 12/540,120, which was filed Aug. 12, 2009, by Edwin J. Sauser, now issued with U.S. Pat. No. 9,862,003, issued on Jan. 9, 2018; and also claims the benefit of provisional patent application entitled "VARIABLE SLOPE 3-SHAFT VIBRATING MECHANISM", having Ser. No. 61/088,987, which was filed on Aug. 14, 2008, by Edwin J. Sauser, all applications are incorporated herein in their entirety by this reference.

FIELD OF THE INVENTION

The present invention generally relates to vibrating screens used in mining or road building material handling and processing.

BACKGROUND OF THE INVENTION

In the past, vibrating screen machines are normally made of a box-like structure mounted on flexible springs and contain one or multiple layers of screen mesh to sort granular materials. The different sized openings in the mesh allow sizing of materials according to the size of these openings. The box structure usually contains an eccentric weighted shaft that shakes the box and its screen mesh to agitate and separate the granular materials fed into the top of the machine.

Vibrating screens can be categorized in many ways. Horizontal (see FIG. 1) and sloped screens (see FIG. 2) are common ways to categorize these screens.

The two designs are used in different applications. The sloped screen decks are desirable in applications where there is a high percentage of "oversize" material that is larger than the openings in the screen cloth. The opening size is determined by the size of the material desired to be removed from the feed material. When too much material is riding on the deck, the material is too deep to efficiently allow fine material to sift through the bed of material and get to the screen cloth for separation. The horizontal screens are more effective when there are difficult conditions requiring more retention time on the screen decks; for example, a high amount of "near size" material. Also, applying water to clean the material is more desirable on horizontal decks, since the sloped decks will wash material down and off the end before it can drop through the screen cloth.

There are many types of triple shaft screens. One could gather a group of prior art sloped screens, each of which has a different single set angle at which the decks are sloped. One thing in common with these sloped machines is that they still utilize a horizontal constructed gear case (See FIG. 2).

Typically, the three-shaft vibrating mechanism consists of three eccentrically weighted shafts geared together, so that the center or second shaft rotates counter of the adjacent first and third shafts. This mechanism utilizes a common gear case with common oil splash lubrication for all gears and bearings. All three shafts are geared together on a common horizontal plane to maintain uniform splash lubrication on all three shaft/bearing assemblies.

The counter rotating center eccentric adds or subtracts from the total vibrator thrust, depending on phase with the outer two eccentrics to create the unique oval motion on the vibrating screen box. It is well known that an oval stroke is preferred and that the manner for producing an oval stroke is also well known.

It is well known that a sloped gear case will, at least when the screen is not operating, let lubrication oil pool to the low end, thus increasing the oil depth on the low end. It is also widely believed that since the oil flows to the lower end, there is a danger of starving the bearings toward the high end of oil. It is also believed that simply increasing the amount of oil in the gear case, and thereby increasing the overall oil depth, would create more splash in the upper end, but would flood the lower bearings, causing excessive heat.

It is also widely believed that if a user desires the ability to utilize triple shaft screening over a wide range of angles, that a collection of several sloped screens, each with a single fixed slope angle, be available. However, this can be extremely expensive and difficult to exchange on the machine in which the screen is operating.

Requiring a horizontal mounting plane of the shaft housings for the multiple shaft style screen which is operating on a sloped orientation requires greater distance between the decks directly above and below the shaft housings since all the housings are not aligned along the upper deck.

Consequently, there is a need for a relatively inexpensive way to provide a triple shaft screen to operate over a wide range of screen slope angles and not require different screens built on different slopes for different applications.

SUMMARY OF THE INVENTION

It is an object of the present invention to provide a vibrating screen machine with geared counter rotating shafts which can be operated with the counter rotating shafts aligned along the slope of the screen surface, whether horizontally or on a sloped plane, without modifying the oil level or lubrication system when the screen is operated at various sloped angles.

It is a possible feature of the present invention to provide a mechanical means configured to assist in raising and lowering a three-shaft vibrating screen over a wide range of angles.

It is another possible feature of the present invention to provide a means and instructions for measuring the slope angle of a screen over a wide range of angles.

It is another possible feature of the present invention to include a system for or perform the step of determining an amount of airborne and otherwise displaced oil in an operating vibrating screen with an inclined three-shaft gear case.

It is an advantage of the present invention to provide for the ability of deploying a single three-shaft vibrating screen over a wide range of angles.

It is also an advantage of the present invention to provide maximum clearance under the shaft housings running through the screen to the screening surface directly below the shaft housings.

The present invention is an apparatus and method for screening material which is designed to satisfy the aforementioned needs, provide the previously stated objects, include the above-listed features, and achieve the already articulated advantages. For some screening operations, the present invention is carried out in an "oil-starved bearing-less system" in a sense that the oil-starved bearings believed to result from excessive incline of the screen during operation have been eliminated.

Accordingly, the present invention is a system and method for operating three-shaft screening operations over a wide range of screen slope angles.

The present invention is a system for screening material comprising:

- a vibrating screen having a material receiving surface;
- means for continuously varying a continuously variable slope angle of said material receiving surface with respect to a ground reference over an extended range of angles which is substantially greater than 3 degrees;
- means for measuring said continuously variable slope angle;
- means for housing a plurality of gears each coupled to one of a plurality of eccentric shafts;
- means for measuring an oil level at a downhill end of said means for housing when said plurality of eccentric shafts are not rotating;
- means for detecting varying reductions in said oil level when said plurality of eccentric shafts are rotated at variable rotation rates; and
- means for regulating rotation rates of said plurality of eccentric shafts so as to maximize a reduction in said oil level from said oil level when said plurality of eccentric shafts are not rotating.

The present invention is also a system for screen material comprising:

- a vibrating screen having a material receiving surface;
- means for varying a variable slope angle of said material receiving surface with respect to a ground reference over an extended range of angles which is greater than 3 degrees;
- means for housing a plurality of gears each coupled to one of a plurality of eccentric shafts;
- means for measuring an oil level at a downhill end of said means for housing when said plurality of eccentric shafts are not rotating;
- means for detecting varying reductions in said oil level when said plurality of eccentric shafts are rotated at variable rotation rates; and
- means for regulating rotation rates of said plurality of eccentric shafts so as to maximize a reduction in said oil level from said oil level when said plurality of eccentric shafts are not rotating.

This invention is further a system for screening material comprising:

- a vibrating screen having a material receiving surface;
- means for varying a variable slope angle of said material receiving surface with respect to a ground reference over a range of angles;
- means for housing a plurality of gears;
- means for measuring an oil level at an end of said means for housing when said plurality of gears are not rotating; and,
- means for detecting varying reductions in said oil level when said plurality of gears are rotated at variable rotation rates.

BRIEF DESCRIPTION OF THE DRAWINGS

The invention may be more fully understood by reading the following description of the preferred embodiments of the invention, in conjunction with the appended drawings wherein.

DETAILED DESCRIPTION

Figure 1:
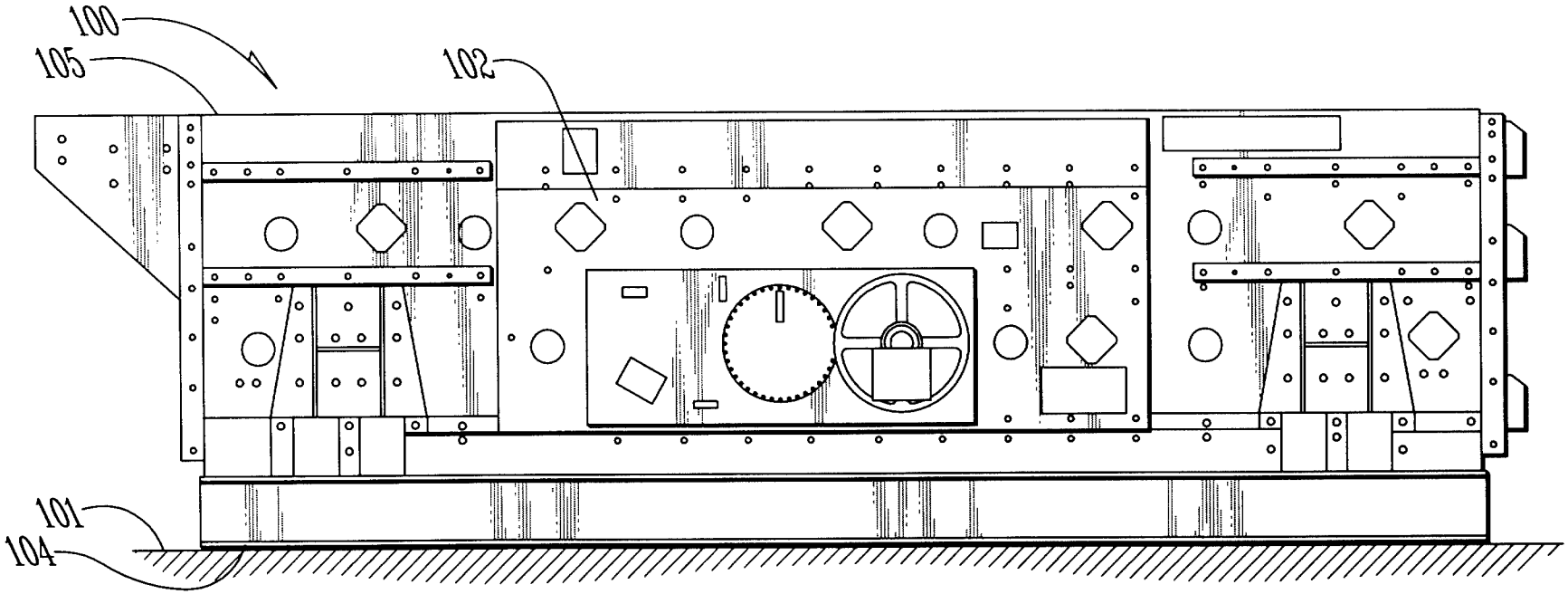
FIG. 1 Prior Art
FIG. 1 is an elevation view of a vibrating screen of the prior art, shown in a horizontal configuration.

Now referring to the drawings wherein like numerals refer to like matter throughout, and more particularly to FIG. 1, there is shown a vibrating screen system 100 of the prior art. Vibrating screen system 100 is a horizontal system which is configured to be used in a level or horizontal orientation, with respect to a ground level 101 which is parallel with and adjacent to system bottom line 104, which is parallel with top screen 105. It should be noted that the gear case 102 is shown in a totally non-skewed level orientation as well; i.e., the gear box 102 is parallel with the top screen 105 and with the ground line 101.

Figure 2:
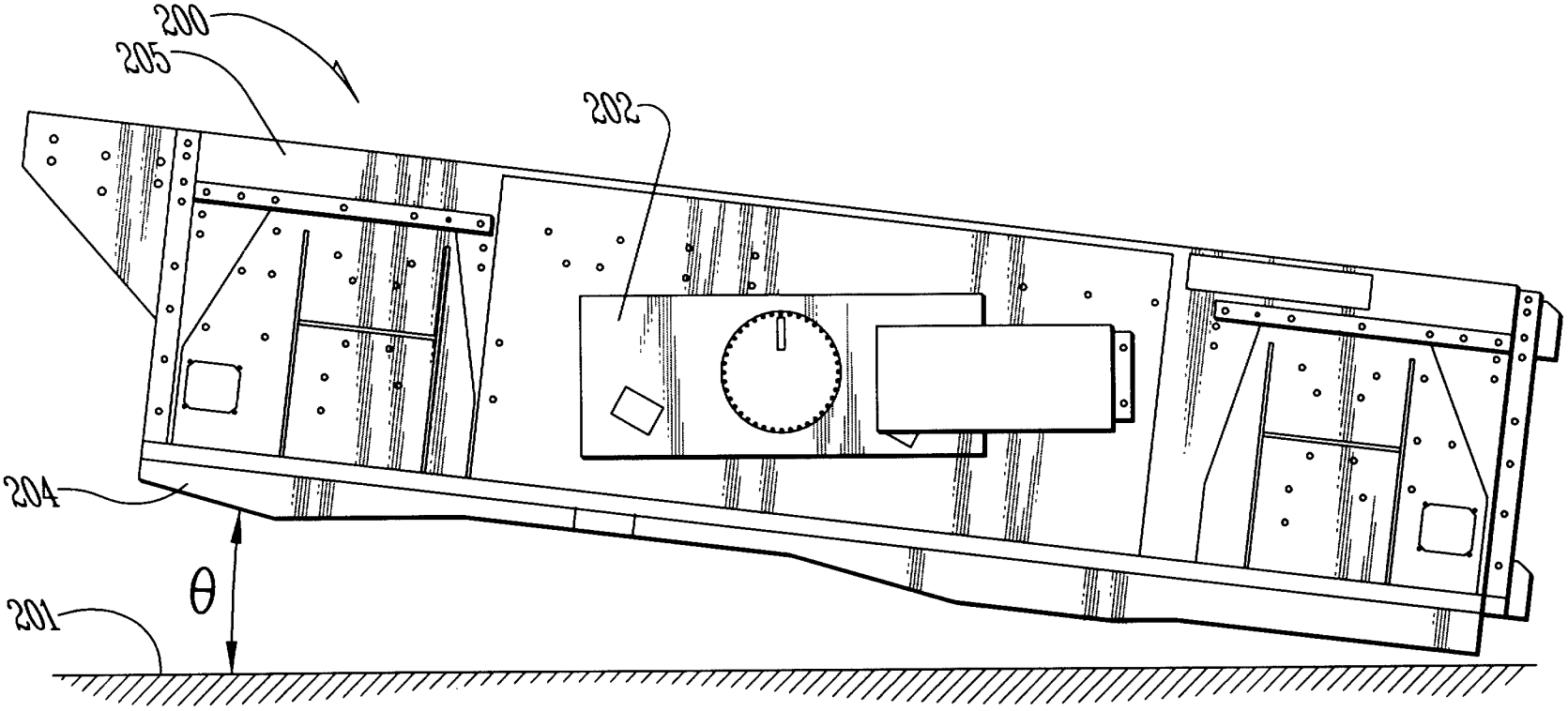
FIG. 2 Prior Art
FIG. 2 is an elevation view of a vibrating screen of the prior art, shown in an inclined operating configuration.

Now referring to FIG. 2, there is shown the vibrating screen system 200 of the prior art which shows a gear box 202 which is skewed with respect to a bottom line 204 of system 200 and with respect to top screen 205, but is level or non-skewed with respect to the ground line 101. The angle between ground line 101 and bottom line 204 is theta 0 and is herein referred to as the slope or the slope angle. In FIG. 1, 0 is 0 and is not shown.

Figure 3:
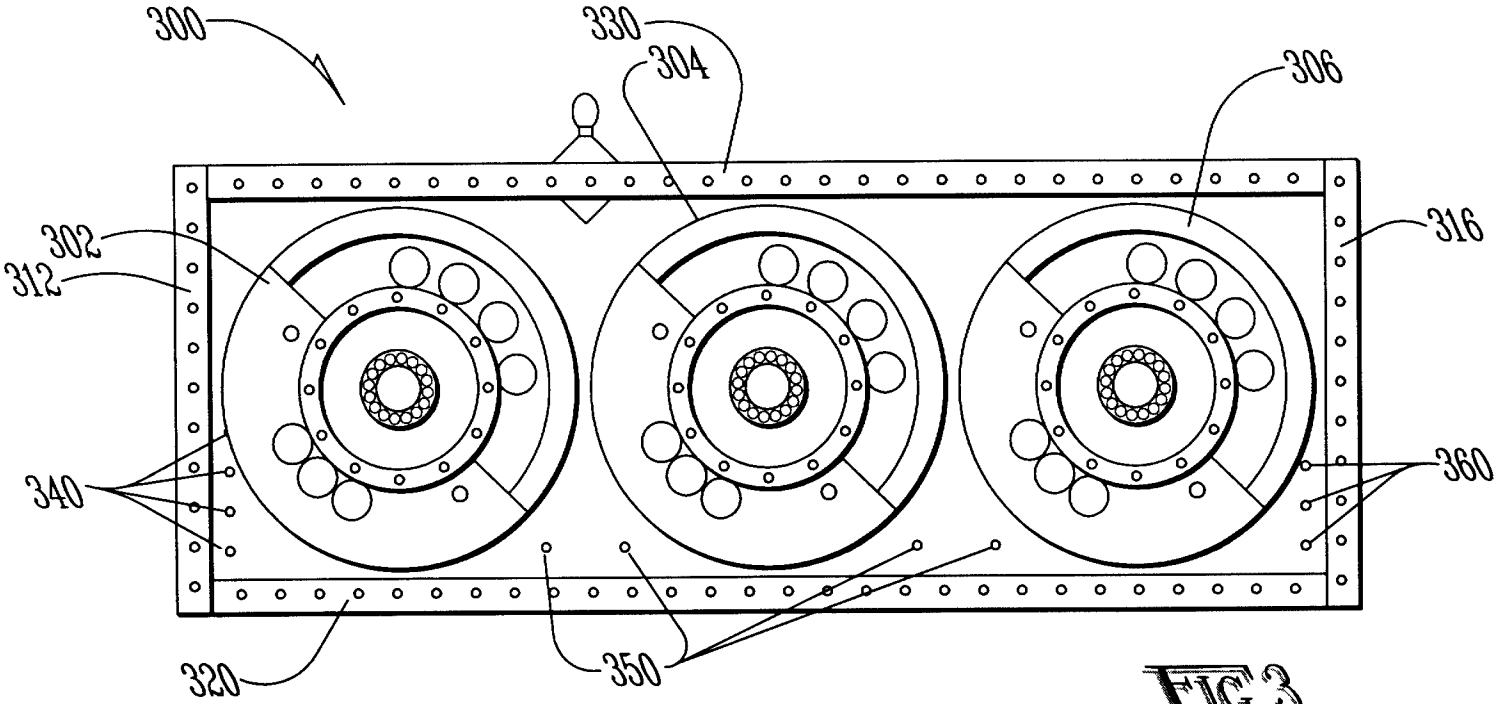
FIG. 3 is a side view of a partially dismantled three-shaft gear box of the present invention.

Now referring to FIG. 3, there is shown a side view of the three-shaft gear box 300 of the present invention, which has a cover removed to expose the internal components. Gear box 300 may employ many well-known prior art structures, including, but not limited to, the system described in U.S. Pat. No. 6,161,650 entitled "Lubricating System for a Vibratory Apparatus", issued on Dec. 19, 2000. three-shaft gear box 300 includes left gear 302, center gear 304, and right gear 306, all disposed between left gear box side 312 and right gear box side 316 and between gear box bottom 320 and gear box top 330. three-shaft gear box 300 is shown having a means for measuring the oil level and oil pool orientation within the three-shaft gear box 300. The means for measuring oil level includes left side vertical oil height sensor array 340, which can be sensors extending vertically at the left side. These sensors can be contact sensors which sense contact with the oil or may be optical sensors paired with opposing optical transmitters on the opposing side of the three-shaft gear box 300. Electrical and mechanical sensors and any other type of sensor could be substituted as well. Bottom oil height sensor array 350 is shown extending across the bottom of the three-shaft gear box 300. This could be a single line of sensors or multiple lines of sensors. Right side vertical oil height sensor array 360 can be similar to left side vertical oil height sensor array 340. Any suitable means for measuring the oil pool level at varying depths and locations could be substituted. In some embodiments of the present invention, it might be desirable to utilize a simpler oil level or oil volume indicator, such as including multiple oil level plugs or a clear sight glass or clear hose, which would permit visual inspection of the oil level and oil volume. If multiple oil level plugs are used, each oil level plug could be associated with a predetermined inclination angle or range of inclination angles.

Figure 4:
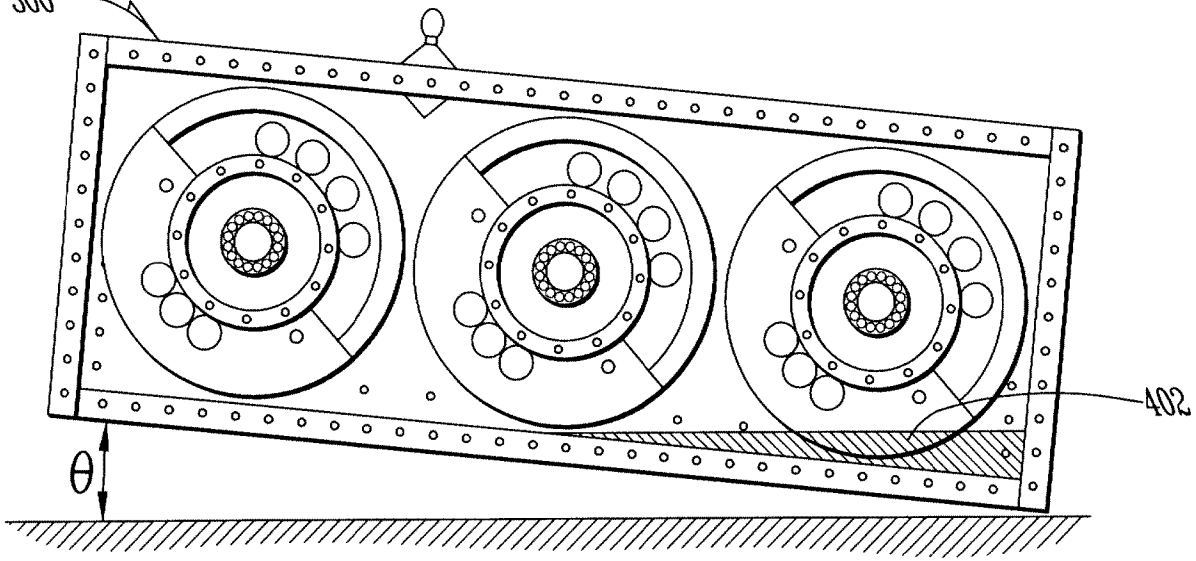
FIG. 4 is a view of the three-shaft gear box of FIG. 3 in an inclined orientation and in a non-operating state.

Now referring to FIG. 4, there is shown the three-shaft gear box 300 of FIG. 3 except that it has been inclined with a slope angle of 0, and non-operating oil pool 402 is also shown. The non-operating oil pool 402 is shown at the downhill end of three-shaft gear box 300, as would be expected.

Figure 5:
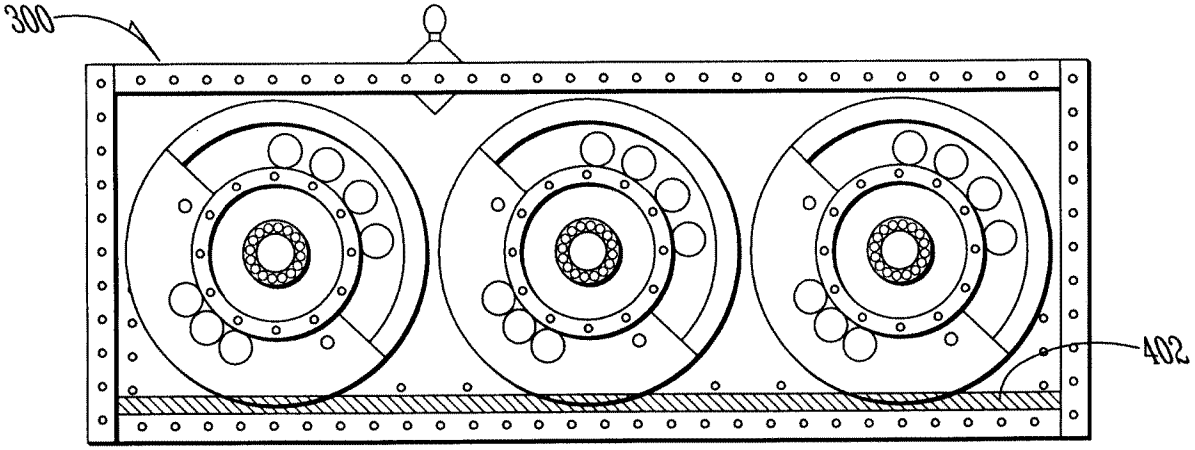
FIG. 5 is a view of the gear box of FIGS. 3-4 shown in a horizontal orientation and in a non-operating state.

Now referring to FIG. 5, there is shown the three-shaft gear box 300 of FIG. 3 except that it has been inclined with a slope angle of 0, where 0 is 0, and non-operating oil pool 402 is also shown. The non-operating oil pool 402 is shown evenly distributed across the three-shaft gear box 300, as would be expected.

Figure 6:
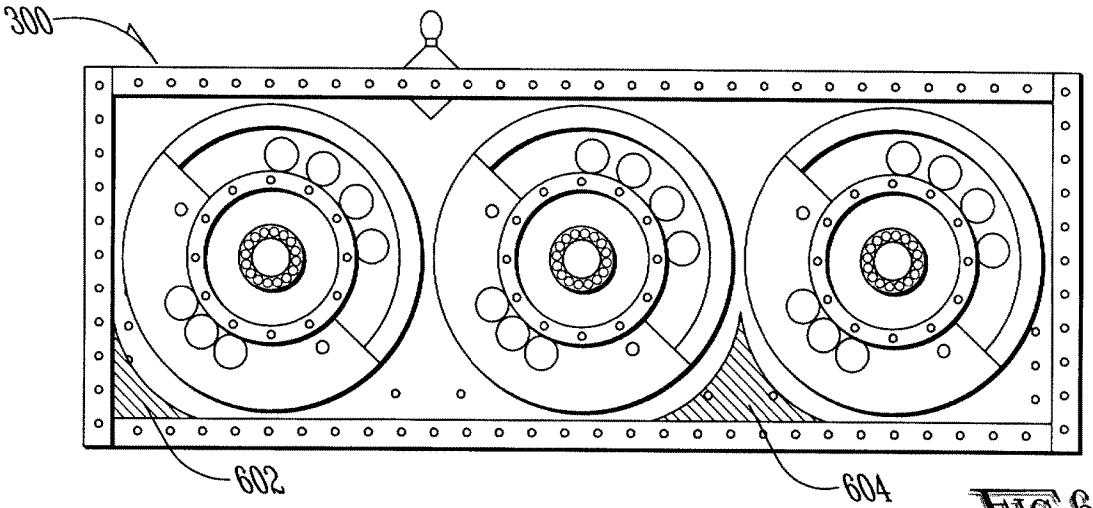
FIG. 6 is a view of the gear box of FIG. 4 in an operating state.

Now referring to FIG. 6, there is shown the three-shaft gear box 300 of FIG. 5 except that it has been inclined with a slope angle of 0, where 0 is 0, and operating oil pool left dead zone 602 is also shown. Operating oil pool right dead zone 604 is also shown. If the oil level determination means determines that no oil is in the bottom right end of the gear box 300, it can be deduced that a large portion of the remainder of the oil is either airborne in a mist, on the gears or in dead zone. If the oil is in either the operating oil pool left dead zone 602 or the operating oil pool right dead zone 604, it will be in contact with each gear and will be providing the desired lubrication. Since many factors can affect the size of the dead zones, such as the temperature, the speed of the gears, the pressure within the gear box, the amount of oil in the gear box, and the slope angle 0, it may be necessary to regulate one or more of these variables (except slope angle 0) to assure that proper dead zones are being maintained for each chosen slope angle 0. The present invention provides all of the information if a thermometer, a pressure sensor and some means for determining oil level are included in the three-shaft gear box 300. The first slope angle determination device 810 can be an electronic sensor coupled with a system for processing data from the other sensors so as to provide information to an i/o device 850, which could be a touch screen display or any suitable substitute. The electronic control system could be used to control at least some of the parameters being monitored so as to regulate the dead zone size.

The "dead" zones in the gear case are believed to allow oil to be pushed into them, preventing excess turbulence and heat buildup from over-churning the oil. The turbulence and air currents are believed to create these dead zones whether the gear case is mounted horizontally or at some angle 0. With the existence of turbulence and the creation of the dead zones, the gear case is able to provide adequate lubrication at any normal screening slope. A screen with a fixed gear case construction will be able to operate horizontally or at an extended range of slope angles, thus increasing the capabilities and applications a single screen machine can operate in. The term "extended range" is used herein to extend from 0 degrees up to 10-15 degrees or more. A range of 0-3 degrees would not be considered an "extended range". "Extended range" should be interpreted to cover various ranges and could include a range from 3-15 degrees or any ranges contained within this range.

Figure 7:
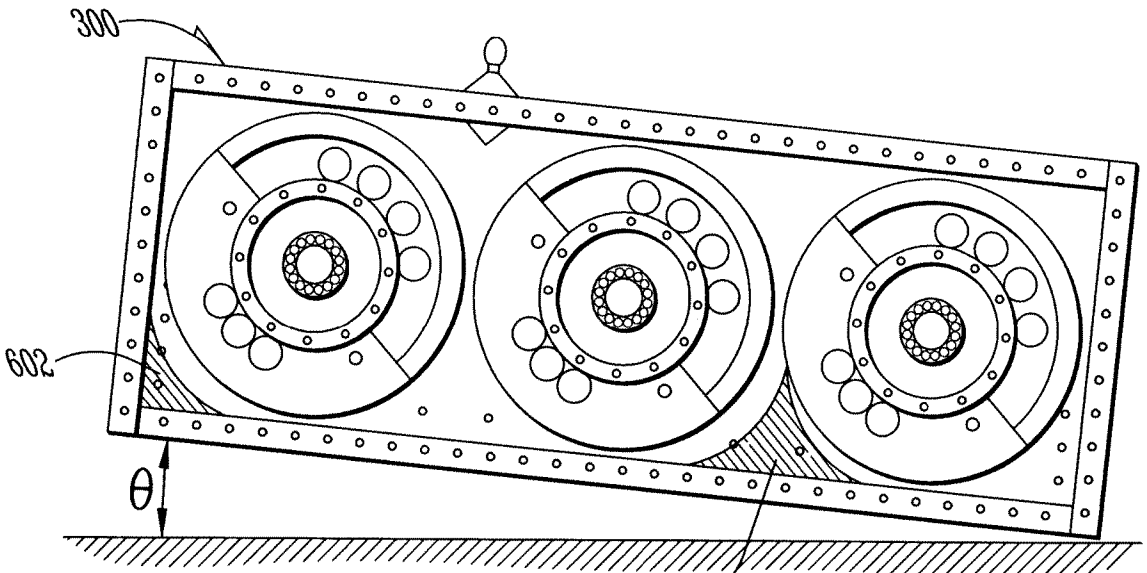
FIG. 7 is a view of the gear box of FIG. 5 in an operating state.

FIG. 7 shows the three-shaft gear box 300 of FIG. 6, but inclined at slope angle.

Figure 8:
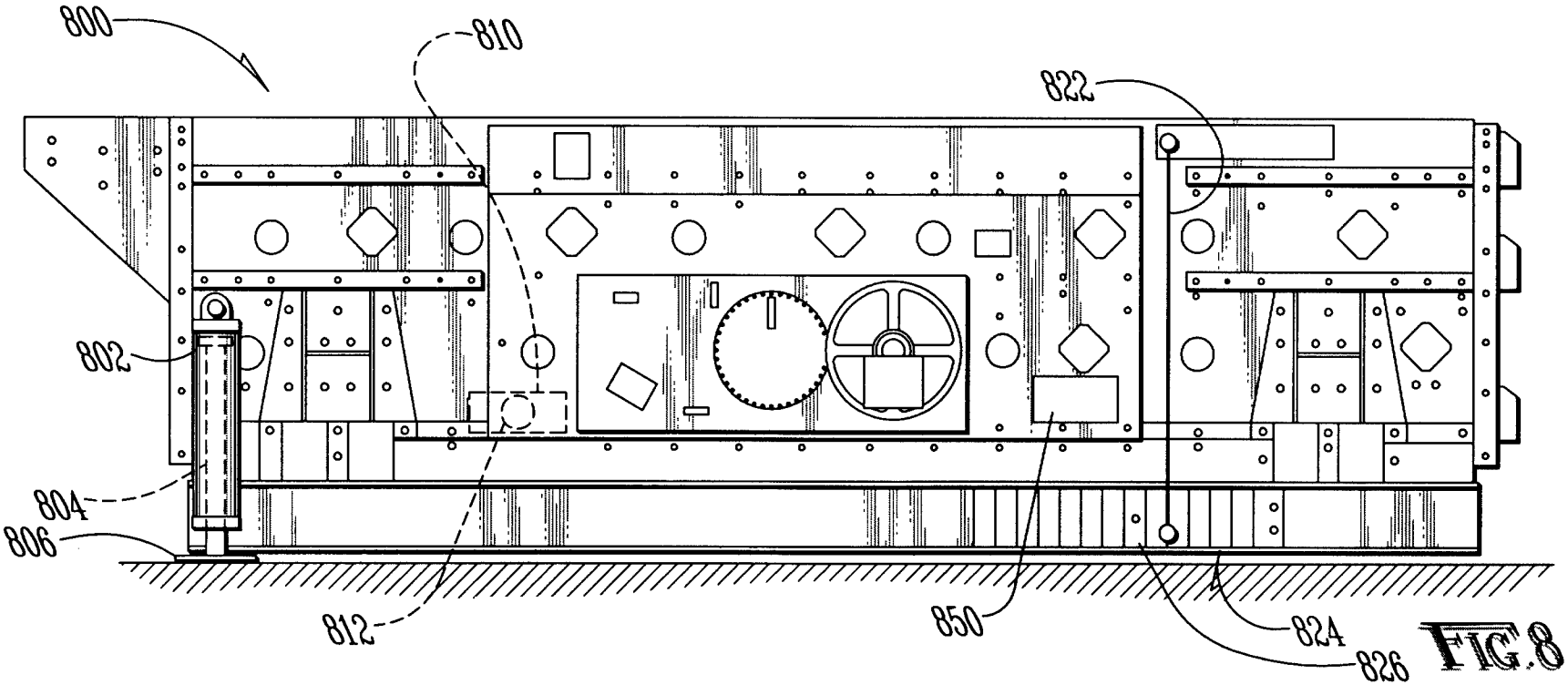
FIG. 8 is a side view of the system of the present invention in a horizontal orientation.

FIG. 8 shows the variable angle screen 800 of the present invention disposed at a slope angle 0 of 0, which can include various additional structural features, such as outer hydraulic cylinder 802, inner hydraulic cylinder 804 and foot pad 806, all shown in a configuration where no lifting forces are being applied to the variable angle screen 800 to create a slope angle 0 greater than 0.

Also shown are first slope angle determination device 810 and air bubble 812, which assumes a simple level mechanism is used. It should be understood that other more or less sophisticated angle determination devices could be used, including electronic and other mechanisms.

Also shown is tether 822 which could be attached to the top of variable angle screen 800 and hang downward to nearly the bottom of variable angle screen 800 at level termination point 826 and acts like a plumb bob. The location of the free end of tether 822 is adjacent the gauge 824, which provides for measurement of slope angle. The location of the tether attached to the vibrating screen section is shown primarily for illustrative purposes and is not preferred. It may be preferred to deploy a similar system on the base or frame section which would not be vibrating as much as the upper sections of the screen. Also shown is computer/communication electronics module 850 which can provide communication and control for any electronic components on variable angle screen 800. Similarly, the electronics module 850 is shown for illustrative purposes, but it may be preferred to mount it at a lower portion on the screen system which vibrates less.

Figure 9:
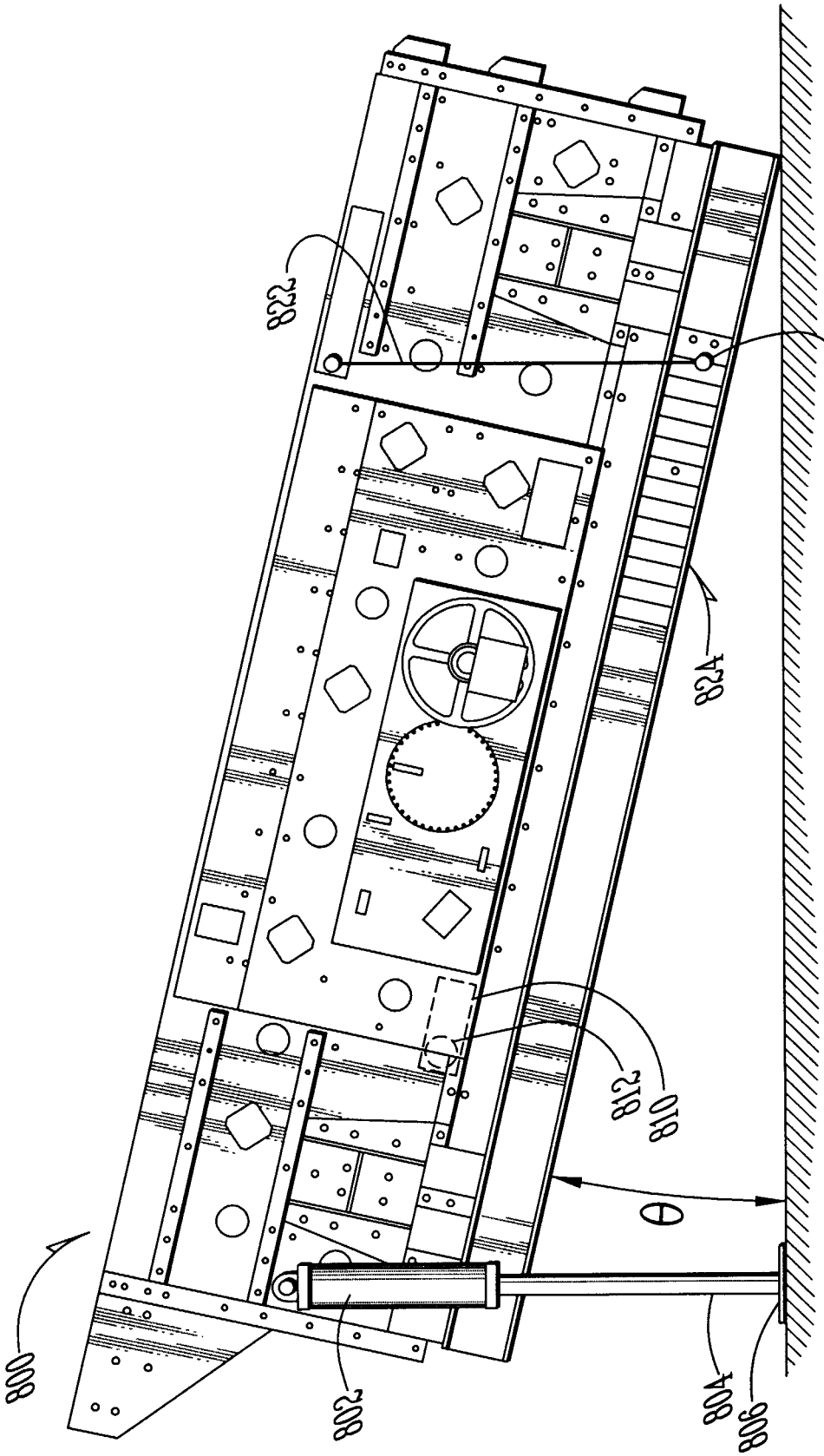
FIG. 9 is a side view of the system of the present invention in an inclined orientation.

FIG. 9 shows a view of the variable angle screen 800 disposed at a non-zero slope angle. Inner hydraulic cylinder 804 is shown exposed, and tether 822 is shown hanging down to inclined termination point 928, which indicates the slope angle when read against the gauge 824.

It should be understood that while the description is focused on three-shaft gear cases, the present invention is intended to include any multiple-shaft gear case from two shafts, three shafts, four shafts or more.

It is thought that the method and apparatus of the present invention will be understood from the foregoing description and that it will be apparent that various changes may be made in the form, construct steps, and arrangement of the parts and steps thereof, without departing from the spirit and scope of the invention or sacrificing all of their material advantages. The form herein described is merely a preferred exemplary embodiment thereof.

I claim:

1. A system for screening material comprising:

a vibrating screen having a material receiving surface;

means for continuously varying a continuously variable slope angle of said material receiving surface with respect to a ground reference over an extended range of angles which is substantially greater than 3 degrees;

means for measuring said continuously variable slope angle;

means for housing a plurality of gears each coupled to one of a plurality of eccentric shafts;

means for measuring an oil level at a downhill end of said means for housing when said plurality of eccentric shafts are not rotating;

means for detecting varying reductions in said oil level when said plurality of eccentric shafts are rotated at variable rotation rates; and means for regulating rotation rates of said plurality of eccentric shafts so as to maximize a reduction in said oil level from said oil level when said plurality of eccentric shafts are not rotating.

2. The system of claim 1 wherein said plurality of gears comprises at least three gears, where each of said plurality of gears is directly coupled to one and only one of said plurality of eccentric shafts.

3. The system of claim 2 further comprising a means for varying an incline of said system over an extended range of angles where said extended range of angles is substantially greater than 3 degrees.

4. The system of claim 3 further comprising a means for measuring a variable slope angle of said system when said slope angle is substantially greater than 3 degrees, measured where 0 degrees is a horizontal system.

5. The system of claim 4 wherein said means for varying an incline comprises a hydraulic cylinder configured to provide a selectable slope angle continuously variable across said extended range of angles.

6. The system of claim 5 wherein said means for measuring comprises a plumb bob and a graduated gauge.

7. The system of claim 5 wherein said means for measuring comprises an electronic control and communication module configured to measure a slope angle and provide an electrical signal in response thereto.

8. A system for screening material comprising:

a vibrating screen having a material receiving surface;

means for varying a variable slope angle of said material receiving surface with respect to a ground reference over an extended range of angles which is greater than 3 degrees;

means for housing a plurality of gears each coupled to one of a plurality of eccentric shafts;

means for measuring an oil level at a downhill end of said means for housing when said plurality of eccentric shafts are not rotating;

means for detecting varying reductions in said oil level when said plurality of eccentric shafts are rotated at variable rotation rates; and means for regulating rotation rates of said plurality of eccentric shafts so as to maximize a reduction in said oil level from said oil level when said plurality of eccentric shafts are not rotating.

9. The system of claim 8 wherein said plurality of gears comprises at least three gears, where each of said plurality of gears is directly coupled to one and only one of said plurality of eccentric shafts.

10. The system of claim 9 further comprising a means for varying an incline of said system over an extended range of angles where said extended range of angles is substantially greater than 3 degrees.

11. The system of claim 10 further comprising a means for measuring a variable slope angle of said system when said slope angle is substantially greater than 3 degrees, measured where 0 degrees is a horizontal system.

12. The system of claim 11 wherein said means for varying an incline comprises a hydraulic cylinder configured to provide a selectable slope angle continuously variable across said extended range of angles.

13. The system of claim 12 wherein said means for measuring comprises a plumb bob and a graduated gauge.

14. The system of claim 12 wherein said means for measuring comprises an electronic control and communication module configured to measure a slope angle and provide an electrical signal in response thereto.

15. A system for screening material comprising:

a vibrating screen having a material receiving surface;

means for varying a variable slope angle of said material receiving surface with respect to a ground reference over a range of angles;

means for housing a plurality of gears;

means for measuring an oil level at an end of said means for housing when said plurality of gears are not rotating; and, means for detecting varying reductions in said oil level when said plurality of gears are rotated at variable rotation rates.

16. The system of claim 15 wherein said plurality of gears comprises at least three gears, where each of said plurality of gears is directly coupled to one and only one of a plurality of eccentric shafts.

17. The system of claim 16 further comprising a means for varying an incline of said system over an extended range of angles where said extended range of angles is substantially greater than 3 degrees.

18. The system of claim 17 further comprising a means for measuring a variable slope angle of said system when said slope angle is substantially greater than 3 degrees, measured where 0 degrees is a horizontal system.

19. The system of claim 18 wherein said means for varying an incline comprises a hydraulic cylinder configured to provide a selectable slope angle continuously variable across said extended range of angles.

20. The system of claim 19 wherein said means for measuring comprises a plumb bob and a graduated gauge.

* * * * *